US007642993B2

(12) United States Patent
Ito

(10) Patent No.: US 7,642,993 B2
(45) Date of Patent: Jan. 5, 2010

(54) DRIVING METHOD OF PLASMA DISPLAY PANEL

(75) Inventor: Kazuhiro Ito, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 712 days.

(21) Appl. No.: 11/155,860

(22) Filed: Jun. 16, 2005

(65) Prior Publication Data

US 2006/0001600 A1 Jan. 5, 2006

(30) Foreign Application Priority Data

Jun. 30, 2004 (KR) ..... 10-2004-0050890

(51) Int. Cl.
*G09G 3/28* (2006.01)

(52) U.S. Cl. ..... 345/63; 345/60; 315/169.1

(58) Field of Classification Search ..... 345/60–68; 315/169.1–169.4

See application file for complete search history.

(56) References Cited

U.S. PATENT DOCUMENTS

| | | | | |
|---|---|---|---|---|
| 5,745,086 | A | 4/1998 | Weber | |
| 6,879,305 | B2 * | 4/2005 | Takeuchi et al. | 345/63 |
| 2003/0030598 | A1 * | 2/2003 | Kanazawa et al. | 345/60 |
| 2004/0207572 | A1 * | 10/2004 | Kishi et al. | 345/60 |
| 2004/0212557 | A1 | 10/2004 | Koo et al. | |
| 2004/0212567 | A1 * | 10/2004 | Kanazawa et al. | 345/60 |

FOREIGN PATENT DOCUMENTS

| | | | |
|---|---|---|---|
| CN | 1203684 | A | 12/1998 |
| JP | 08-320667 | | 12/1996 |
| JP | 11-065516 | | 3/1999 |
| JP | 11-149274 | | 6/1999 |
| JP | 11-242460 | | 9/1999 |
| JP | 2000-122603 | | 4/2000 |
| JP | 2001-13910 | A | 1/2001 |
| JP | 2001-035395 | | 2/2001 |
| JP | 2001-075526 | | 3/2001 |

(Continued)

OTHER PUBLICATIONS

Patent Abstracts of Japan for Publication No. 08-320667; dated Dec. 3, 1996 in the name of Giichi Kanazawa.

(Continued)

*Primary Examiner*—Richard Hjerpe
*Assistant Examiner*—Kimnhung Nguyen
(74) *Attorney, Agent, or Firm*—Christie, Parker & Hale, LLP

(57) ABSTRACT

A method for driving a plasma display panel having a plurality of first electrodes, a plurality of second electrodes, and a plurality of third electrodes provided in a direction crossing the first and second electrodes while one frame is divided into a plurality of subfields, the plurality of first electrodes being divided into a plurality of groups each including a first group and a second group, and the plurality of second electrodes being biased at a first voltage during a reset period, an address period, and a sustain period. During the address period, a second voltage is selectively applied to a plurality of first electrodes included in the first group. A third voltage lower than the second voltage is selectively applied to a plurality of first electrodes included in the second group.

16 Claims, 9 Drawing Sheets

FOREIGN PATENT DOCUMENTS

| | | | |
|---|---|---|---|
| JP | 2002-062844 | | 2/2002 |
| JP | 2002-132205 | | 5/2002 |
| JP | 2002-132209 | A | 5/2002 |
| JP | 2002-140032 | A | 5/2002 |
| JP | 2003-050563 | | 2/2003 |
| JP | 2003-271092 | A | 9/2003 |
| JP | 2003-345292 | A | 12/2003 |
| KR | 2003-0027173 | | 4/2003 |
| WO | WO 02/058041 | A1 | 7/2002 |
| WO | WO 02/099778 | A1 | 12/2002 |

OTHER PUBLICATIONS

Patent Abstracts of Japan for Publication No. 11-065516; dated Mar. 9, 1999 in the name of Takeo Masuda, et al.

Patent Abstracts of Japan for Publication No. 11-149274; dated Jun. 2, 1999 in the name of Yasutaka Inanaga.

Patent Abstracts of Japan for Publication No. 2000-122603; dated Apr. 28, 2000 in the name of Hideyuki Asai, et al.

Patent Abstracts of Japan for Publication No. 2001-035395; dated Feb. 9, 2001 in the name of Kyoung Ho Kang, et al.

Patent Abstracts of Japan for Publication No. 2001-075526; dated Mar. 23, 2001 in the name of Makoto Onozawa, et al.

Patent Abstracts of Japan for Publication No. 2002-062844; dated Feb. 28, 2002 in the name of Tomokatsu Kishi, et al.

Patent Abstracts of Japan for Publication No. 2002-132205; dated May 9, 2002 in the name of Seiki Nishimura, et al.

Patent Abstracts of Japan for Publication No. 2003-050563; dated Feb. 21, 2003 in the name of Katsutoshi Shindo, et al.

European Search Report, dated Oct. 20, 2005, for Application No. 05105430.2, in the name of Samsung SDI Co., Ltd.

Korean Patent Abstracts for Publication No. 1020030027173, Date of publication of application: Apr. 7, 2003, in the name of Seong Won Ji.

Japan Patent Abstracts for Publication No. 11-242460; Date of publication of application: Sep. 7, 1999, in the name of Tsutomu Tokunaga et al.

* cited by examiner

DRIVING METHOD OF PLASMA DISPLAY PANEL

CROSS-REFERENCE TO RELATED APPLICATION

This application claims priority to and the benefit of Korean Patent Application No. 10-2004-0050890 filed in the Korean Intellectual Property Office on Jun. 30, 2004, the entire content of which is incorporated herein by reference.

BACKGROUND OF THE INVENTION

1. Field of the Invention

The present invention relates to a driving method of a plasma display panel (PDP).

2. Description of the Related Art

A PDP is a display panel that uses plasma generated by gas discharge to display characters or images. It includes, depending on its size, more than several scores to millions of pixels arranged in a matrix pattern. Such a PDP is classified as a direct current (DC) type or an alternating current (AC) type according to its discharge cell structure and the waveform of the driving voltage applied thereto.

The DC PDP has electrodes exposed to a discharge space, and accordingly, it allows DC to flow through the discharge space while a voltage is applied. Therefore, such a DC PDP problematically requires a resistor for limiting the current. On the other hand, the AC PDP has electrodes covered with a dielectric layer that forms a capacitor to limit the current and protects the electrodes from the impact of ions during discharge. Accordingly, the AC PDP has a longer lifetime than the DC PDP.

In general, one frame of an AC PDP is divided into a plurality of subfields, and each subfield includes a reset period, an address period, and a sustain period.

The reset period is for initializing a condition of each cell so as to facilitate an addressing operation on the cell, The address period is for selecting turn-on/turn-off cells (i.e., cells to be turned on or off) and accumulating wall charges to the turn-on cells (i.e., addressed cells). The sustain period is for causing a discharge for displaying an image on the addressed cells.

In order to perform the above-described operation, sustain discharge pulses are alternatively applied to scan electrodes and sustain electrodes during the sustain period, and reset waveforms and scan waveforms are applied to the scan electrodes during the reset period and the address period. Therefore, a scan driving board for driving the scan electrodes and a sustain driving board for driving the sustain electrodes are separately needed. In this instance, a problem of mounting the driving boards on a chassis base may be generated, and the cost increases because of the separate driving boards.

When a driving circuit formed in a sustain driving board is coupled to a scan driving board to reduce the cost of the driving boards, the length of a wire (or a conductive pattern) connected between the scan driving board and the sustain electrode is extended. Therefore, an impedance component formed at the extended sustain electrode is increased.

SUMMARY OF THE INVENTION

In accordance with the present invention a method for driving a plasma display panel is provided having the advantages of triggering a stable address discharge when a sustain driving board that drives sustain electrodes is removed.

To solve the foregoing problem, a driving waveform is applied to a scan electrode while the sustain electrode is biased at a constant voltage.

In one aspect of the present invention, a method is provided for driving a PDP having a plurality of first electrodes, a plurality of second electrodes, and a plurality of third electrodes provided in a direction crossing the first and second electrodes. One frame is divided into a plurality of subfields. The plurality of first electrodes are divided into a plurality of groups, each group including a first group and a second group. The plurality of second electrodes are biased at a first voltage during a reset period, an address period, and a sustain period The method includes, during the address period, selectively applying a second voltage to a plurality of first electrodes included in the first group, and selectively applying a third voltage lower than the second voltage to a plurality of first electrodes included in the second group.

In the method, during the reset period, a voltage of the first electrode may gradually increase from a fourth voltage to a fifth voltage, and a voltage of the first electrode gradually decreases from a sixth voltage to a seventh voltage. A voltage of the third electrode may be set to be a positive voltage during at least a portion of a period in which a level of the voltage of the first electrode increases to a level of the fifth voltage.

In another aspect of the present invention, a method is provided for driving a plasma display panel having a plurality of first electrodes, a plurality of second electrodes, and a plurality of third electrodes extended in a direction crossing the first and second electrodes. One frame is divided into a plurality of subfields. At least one subfield among the plurality of subfields includes a main reset period initializing discharge cells in all conditions. At least one subfield of the plurality of subfields includes an auxiliary reset period initializing discharge cells that have experienced a sustain discharge in a previous subfield. The plurality of second electrodes are biased at a first voltage during a reset period, an address period, and a sustain period. The method includes, during the address period, selectively applying a second voltage to the plurality of first electrodes, wherein a second voltage in the at least one subfield including the main reset period is higher than a second voltage in the at least one subfield including the auxiliary reset period.

In the method, during the reset period, a voltage of the first electrode may gradually decrease from a third voltage to a fourth voltage. A difference between a second voltage and a fourth voltage in the at least one subfield including the main reset period may be less than a difference between a second voltage and a fourth voltage in the at least one subfield including the auxiliary reset period.

In the method, during the main reset period, a voltage of the first electrode may gradually increase from a fifth voltage to a sixth voltage. A voltage of the third electrode may be set to be a positive voltage during at least a portion of a period in which a level of the voltage of the first electrode increases to a level of the sixth voltage.

DETAILED DESCRIPTION

Figure 1:
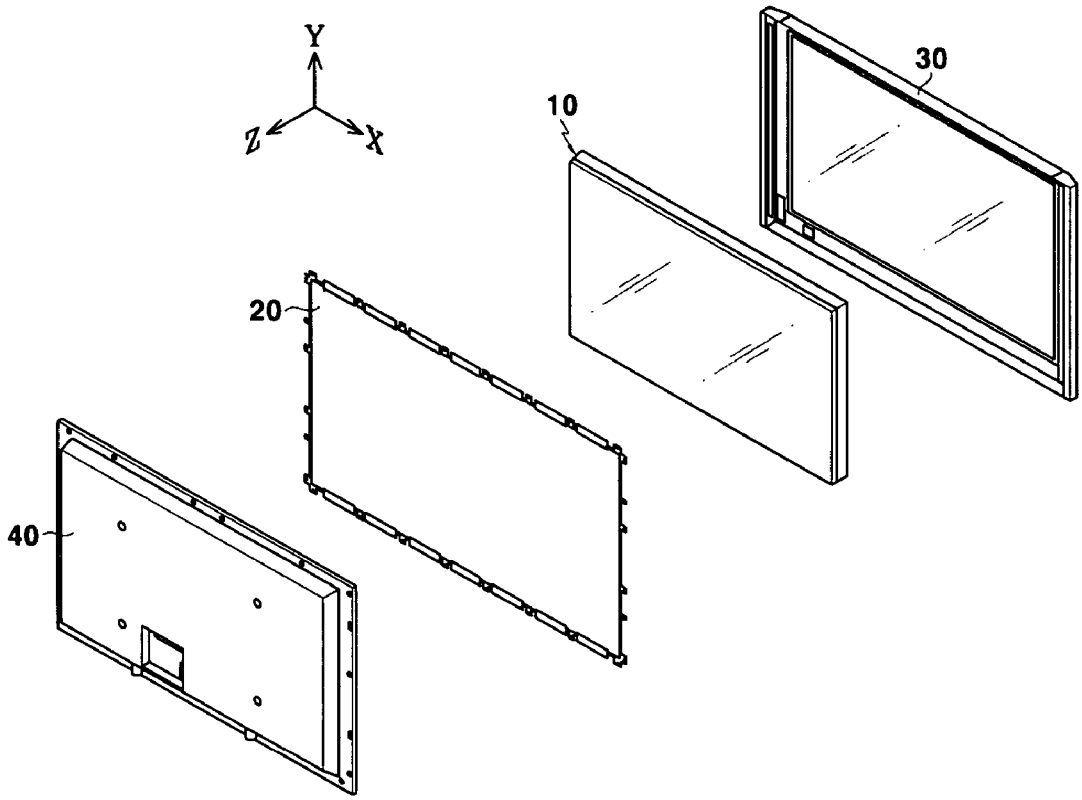
FIG. 1 is an exploded perspective view of a plasma display device according to an exemplary embodiment of the present invention.
Figure 2:
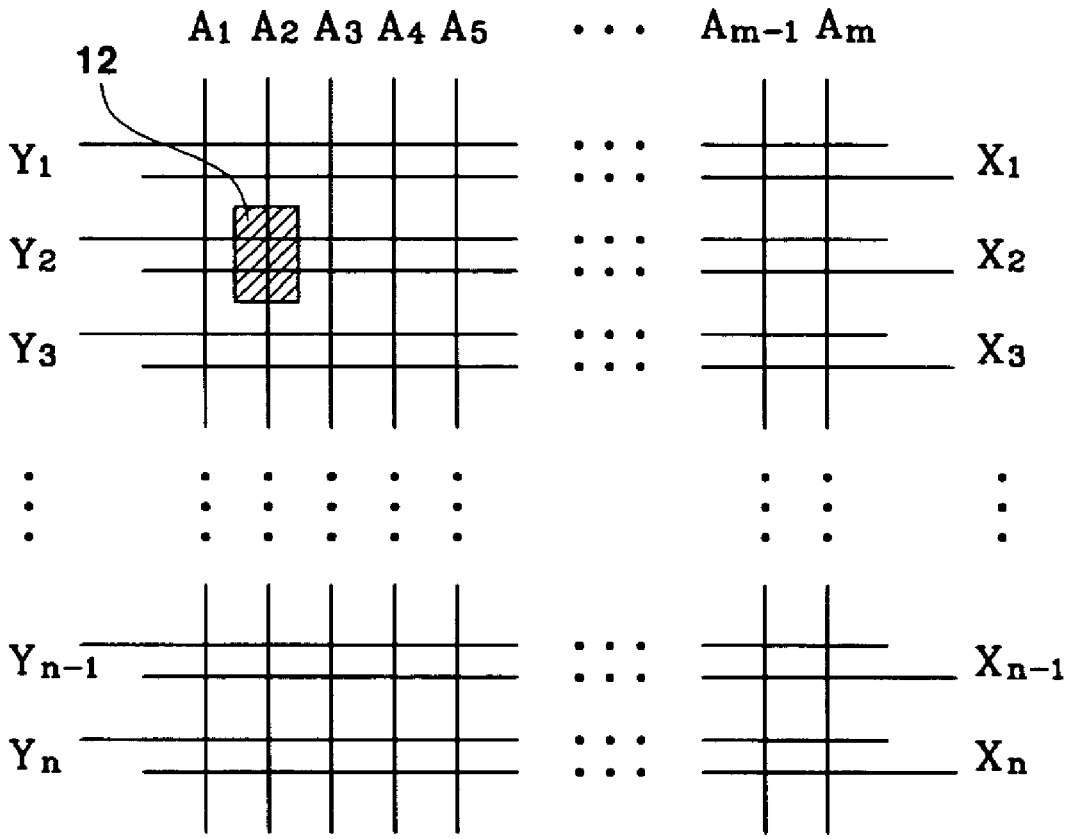
FIG. 2 is a schematic view of a plasma display panel according to an exemplary embodiment of the present invention.
Figure 3:
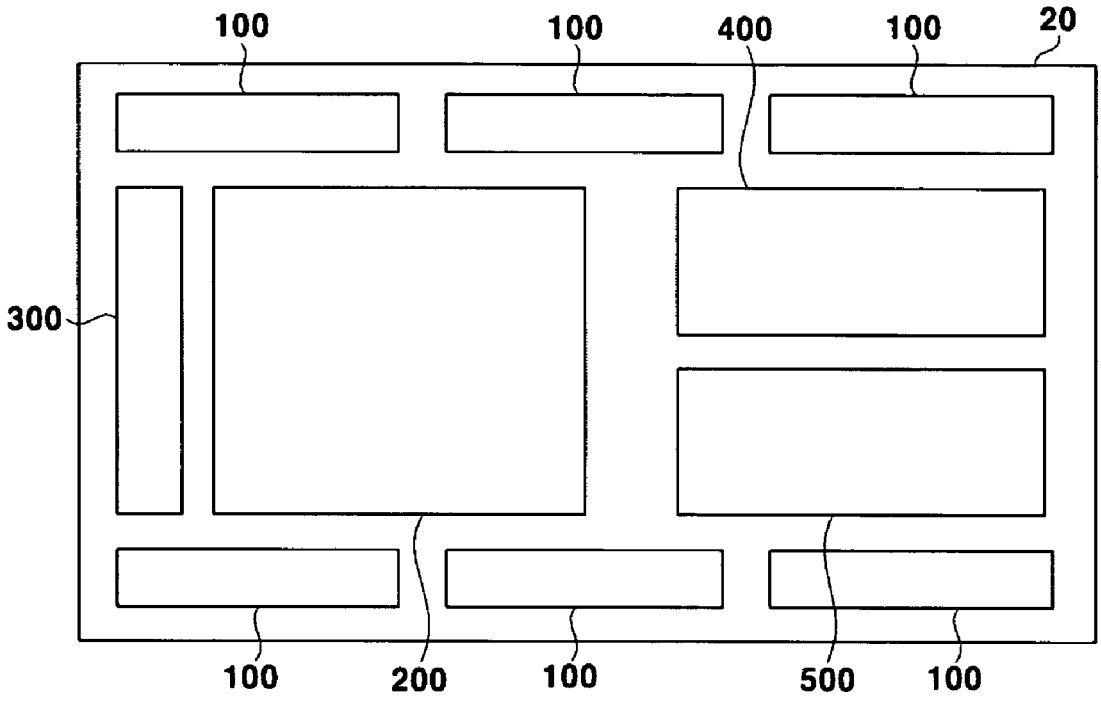
FIG. 3 is a schematic top plan view of a chassis base according to an exemplary embodiment of the present invention.

Referring now to FIG. 1, FIG. 2, and FIG. 3, a schematic configuration of a plasma display device according to an exemplary embodiment of the present invention is shown.

As shown in FIG. 1, the plasma display device includes a PDP 10, a chassis base 20, a front case 30, and a rear case 40. The chassis base 20 is coupled to the PDP 10 opposite an image display side of the PDP 10. The front case 30 is coupled to the plasma display panel 10 on the image display side of the plasma display panel 10. The rear case 40 is coupled to the chassis base 20. The assembly of these parts forms a plasma display device.

As shown in FIG. 2, the PDP 10 of FIG. 1 includes a plurality of address electrodes A1-Am extended in a column direction, and a plurality of scan electrodes Y1-Yn and a plurality of sustain electrodes X1-Xn each extended in a row direction. The respective sustain electrodes X1-Xn correspond to the respective scan electrodes Y1-Yn. The PDP 10 includes substrates on which the sustain electrodes X1-Xn and the scan electrodes Y1-Yn are respectively arranged. The two substrates are arranged to face each other with discharge spaces therebetween so that the scan electrodes Y1-Yn and the sustain electrodes X1-Xn may respectively cross the address electrodes A1-Am. In this instance, discharge spaces at crossing regions of the address electrodes A1-Am and the sustain and scan electrodes X1-Xn and Y1-Yn form discharge cells. FIG. 1 and FIG. 2 show an exemplary structure of the PDP 10, and the PDP 10 may have a different configuration to which the following driving waveforms can be applied.

As shown in FIG. 3, driving boards 100, 200, 300, 400, 500 for driving the PDP 10 are formed on the chassis base 20. Address buffer boards 100 are formed on a top and a bottom of the chassis base 20, and may be altered depending on a driving scheme. FIG. 3 exemplifies a dual driving plasma display device, but the address buffer boards 100 are arranged on either the top or the bottom of the chassis base 20. The address buffer boards 100 receive address driving control signals from the image processing and controlling board 400, and apply voltages for selecting a turn-on cell to the appropriate address electrodes A1-Am.

A scan driving board 200 is provided on the left of the chassis base 20 and is electrically coupled to the scan electrodes Y1-Yn through a scan buffer board 300, and the sustain electrodes X1-Xn are biased at a constant voltage. During an address period, the scan buffer board 300 applies a voltage to the scan electrodes Y1-Yn for sequentially selecting scan electrodes Y1-Yn during the address period. The scan driving board 200 receives a driving signal from an image processing and controlling board 400 and applies a driving voltage to the selected scan electrodes. While in FIG. 3 the scan driving board 200 and the scan buffer board 300 are shown on the left of the chassis base 20, they may be located on the right of the chassis base 20. The scan buffer board 300 and the scan driving board 200 may be formed together as one integral part.

Upon receiving an external image signal, the image processing and controlling board 400 generates control signals for driving the address electrodes A1-Am and for driving the scan and sustain electrodes Y1-Yn and X1-Xn, and respectively applies the control signals to the address driving board 100 and the scan driving board 200. A power supply board 500 supplies power for driving the plasma display device. The image processing and controlling board 400 and the power supply board 500 may be located on a central area of the chassis base 20.

The address buffer board 100, the scan driving board 200, and the scan buffer board 300 form a driver for driving the address and scan electrodes, the image processing and controlling board 400 forms a controller for controlling the driver, and the power supply board 500 forms a power source for supplying power to the driver and the controller.

A driving waveform of a PDP according to a first exemplary embodiment of the present invention will now be described with reference to FIG. 4. In the following description, the driving waveform applied to a scan electrode (Y electrode), a sustain electrode (X electrode), and an address electrode (A electrode) is described in connection with only one cell, for better comprehension and convenience of description. In addition, in the driving waveform of FIG. 4, a voltage applied to the Y electrode is supplied from the scan driving board 200 and the scan buffer board 300, and a voltage applied to the A electrode is supplied from the address buffer board 100. Since the X electrode is biased at a reference voltage (a 0V or ground voltage), the voltage applied to the X electrode is not described in further detail.

Figure 4:
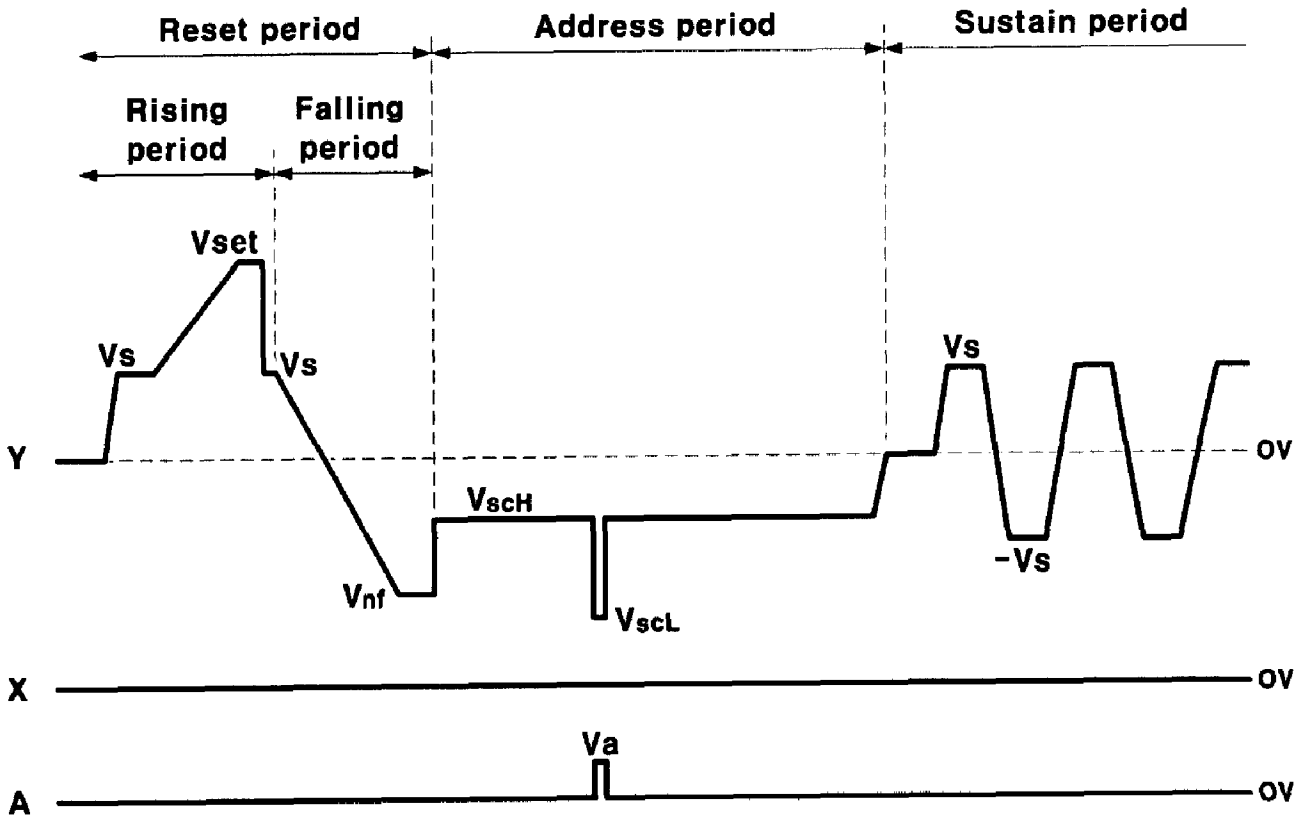
FIG. 4 is a driving waveform diagram of a plasma display panel according to a first exemplary embodiment of the present invention.

As shown in FIG. 4, a subfield includes a reset period, an address period, and a sustain period, wherein the reset period includes a rising period and a falling period.

During the rising period of the reset period, the voltage of the Y electrode is increased from a voltage Vs to a voltage Vset while maintaining the A electrode at a reference voltage 0V level. The voltage of the Y electrode increases according to a ramp pattern. While the voltage of the Y electrode increases, a weak discharge occurs between the Y and X electrodes and between the Y and A electrodes. Accordingly, negative (−) wall charges are formed on the Y electrode, and positive (+) wall charges are formed on the X and A electrodes. A wall charge being described in accordance with the present invention means a charge formed on a wall (e.g., a dielectric layer) close to each electrode of a discharge cell and accumulated on the electrode. The wall charge will be described as being "formed" or "accumulated" on the electrode even though the wall charges do not actually touch the electrodes. Further, a wall voltage means a potential difference formed on the wall of the discharge cell by the wall charge.

When the voltage of the Y electrode changes gradually, as shown in FIG. 4, a weak discharge is caused in a cell, and accordingly wall charges are formed such that a sum of an externally applied voltage and the wall charge may be maintained at a discharge firing voltage. Such a process for forming wall charges is disclosed in U.S. Pat. No. 5,745,086 by Weber. The voltage Vset is a voltage high enough to fire a discharge in cells of any condition because every cell has to be initialized in the reset period.

During the falling period of the reset period, the voltage of the Y electrode is gradually decreased from the voltage Vs to a voltage Vnf while the voltage of the A electrode is maintained at the reference voltage 0V. As a result, a weak discharge is generated between the Y and X electrodes and between the Y and A electrodes while the voltage of the Y electrode is decreased. Accordingly, the negative (−) wall charges formed on the Y electrode and the positive (+) wall charges formed on the A electrode are eliminated. The voltage Vnf is set to be close to a discharge firing voltage between the Y and X electrodes. Then a wall voltage between the Y and X electrodes reaches near 0V, and therefore a cell that was not addressed with an address discharge during the address period may be prevented from misfiring during the sustain period. In addition, the wall voltage between the Y and A electrodes is determined by the magnitude of the voltage Vnf since the voltage of the A electrode is maintained at the reference voltage 0V.

Subsequently, during the address period for selecting turn-on cells, a scan pulse VscL, and an address pulse Va are applied to Y and A electrodes of the turn-on cells, respectively. A non-selected Y electrode is biased at a voltage VscH that is higher than the VscL, and the reference voltage 0V is applied to the A electrode of the cells being turned off. In this instance, the voltage VscL is called a scan voltage, and the voltage VscH is called a non-scan voltage. Then, an address discharge is generated in a cell defined by the A electrode applied with the voltage Va and the Y electrode applied with the voltage VscL, and accordingly, the positive (+) wall charges are formed on the Y electrode and the negative (−) wall charges are formed on the A electrode and X electrode.

The scan buffer board 300 selects a Y electrode to be applied with the scan pulse VscL, among the Y electrodes Y1-Yn. For example, in a single driving method, the Y electrode may be selected according to an order of arrangement of the Y electrodes in the column direction. When a Y electrode is selected, the address buffer board 100 selects turn-on discharge cells among discharge cells formed on the selected Y electrode. That is, the address buffer board 100 selects A electrodes to be applied with the address pulse of the voltage Va, among the A electrodes A1-Am.

In more detail, the scan pulse of the voltage VscL is first applied to the scan electrode (Y1 shown in FIG. 2) in the first row. At the same time, the address pulse of the voltage Va is applied to an A electrode on a turn-on cell along the first row. Then a discharge is generated between the Y electrode in the first row and the A electrode receiving the address pulse. Accordingly, positive (+) wall charges are formed on the Y electrode and negative (−) wall charges are formed on the A and X electrodes. As a result, a wall voltage Vwxy is formed between the X and Y electrodes with the potential of the wall adjacent to the Y electrode higher than the potential of the wall adjacent to the X electrode. Subsequently, while the scan voltage the voltage VscL is applied to the Y electrode (Y2 shown in FIG. 2) in a second row, the address pulse of the voltage Va is applied to the A electrodes in turn-on cells along the second row. Then, the address discharge occurs in the cells crossed by the A electrodes receiving the voltage Va and the Y electrode in the second row, and accordingly, the wall charges are formed in such cells, in a like manner as described above. Regarding Y electrodes in other rows, wall charges are formed in turn-on cells in the same manner as described above, i.e., by applying the address pulse of the voltage Va to A electrodes on turn-on cells while sequentially applying a scan pulse of the voltage VscL to the Y electrodes.

During the address period described above, the voltage VscL is usually set equal to or less than the voltage Vnf, and the voltage Va is usually set greater than the reference voltage 0V. Generation of an address discharge by applying the voltage Va to the A electrode is hereinafter described in connection with the case in which the voltage VscL equals the voltage Vnf. When the voltage Vnf is applied in the reset period, a sum of the wall voltage between the A and Y electrodes and the external voltage Vnf between the A and Y electrodes reaches the discharge firing voltage Vfay between the A and Y electrodes. When the A electrode is applied with 0V and the Y electrode is applied with the voltage VscL, which is equal to Vnf in this case, the voltage Vfay is formed between the A and Y electrodes, and accordingly the generation of a discharge may be expected. However, if the voltage Va is applied to the A electrode while the voltage VscL (=Vnf) is applied to the Y electrode, a voltage greater than the voltage Vfay is formed between the A and Y electrodes such that the discharge delay is reduced to less than the width of the scan pulse, allowing a discharge to be generated. At this time, generation of the address discharge may be facilitated by setting the voltage VscL to be less than the voltage Vnf.

Subsequently, during the sustain period, sustain discharge is triggered between the Y and X electrodes by initially applying a pulse of the voltage Vs to the appropriate Y electrode. Just before the application of this voltage, the wall voltage Vwxy is formed such that the potential of the Y electrode is higher than the X electrode in the cell having undergone the address discharge in the address period. During the sustain period, the voltage Vs is set to be lower than the discharge firing voltage Vfxy. In this manner, the wall voltage Vwxy, from the Y electrode to the X electrode, existing before the application of Vs does not generate a discharge. At this time, once Vs arrives, the sum of these two generally positive voltages will reach above the required discharge firing voltage between the X and Y electrodes and a discharge is sustained.

Now, a sustain discharge pulse of a negative voltage −Vs is applied to the Y electrode to fire a subsequent sustain discharge. Therefore, positive (+) wall charges are formed on the Y electrode and negative (−) wall charges are formed on the X and A electrodes, such that another sustain discharge may be fired by applying the voltage Vs to the Y electrode. Subsequently, the process of alternately applying the sustain pulses of voltages Vs and −Vs to the scan electrode Y is repeated by a number corresponding to a weight value of a corresponding subfield.

As described above, according to the first embodiment of the present invention, reset, address, and sustain operations may be performed by a driving waveform applied only to the Y electrode while the X electrode is biased at the reference voltage 0V. Therefore, a driving board for driving the X electrode is not required, and the X electrode may stay simply biased at a reference voltage 0V. In addition, since the sustain discharge pulse is supplied from the scan driving board 300 only, impedance of a path through the sustain discharge pulse is supplied may be set to be constant.

As shown in FIG. 4, during the falling period of the reset period, a final voltage Vnf applied to the Y electrode is set close to the discharge firing voltage between the Y and X electrodes. However, a wall potential of the Y electrode with respect to the A electrode may be a positive voltage at the final voltage Vnf of the falling period because the discharge firing voltage Vfay between the Y and A electrodes is generally less than discharge firing voltage Vfxy between the Y and X electrodes. A reset period of a subsequent subfield begins while the above wall charge state is maintained in the cells because the sustain discharge is not generated in cells that have not experienced an address discharge. In the above state of the cell, the wall potential of the Y electrode with respect to the X electrode is higher than the wall potential of the Y electrode with respect to the A electrode. Therefore, when the voltage of the Y electrode is increased in the rising period of the reset period, the voltage between the X and Y electrodes may exceed the discharge firing voltage in a predetermined time after the voltage between the A and Y electrodes exceeds the discharge firing voltage Vfay.

Figure 5:
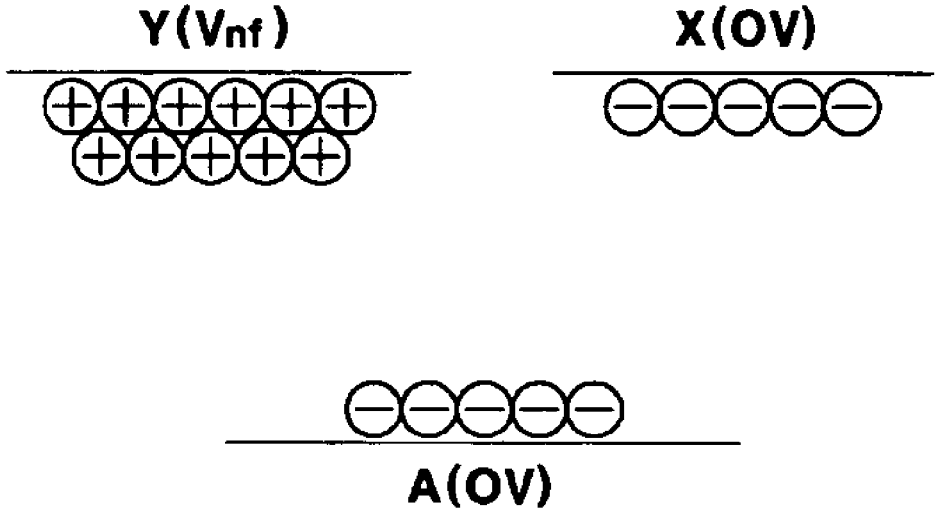
FIG. 5 shows a wall charge condition of a cell when a strong discharge is generated in a reset period.

In the PDP 10 as described above, the X and Y electrodes are typically covered with a material of a high secondary electron emission coefficient for increasing sustain-discharge performance, while the A electrode is covered with a phosphor for color representation. An MgO film may be used for such a material of a high secondary electron emission coefficient. The discharge in the cell is determined by an amount of second electrons emitted from the cathode when positive ions collide against the cathode. The secondary electron emission from the Y electrode is referred to as a "y process." During the rising period of the reset period, the Y electrode operates as an anode and the A electrode and X electrode operate as a cathode because a higher voltage is applied to the Y electrode. During the rising period of the reset period, however, the discharge may be delayed between the A and Y electrodes because the phosphor covered the A electrode operates as the cathode when the voltage between the A and Y electrodes exceeds the discharge firing voltage Vfay. Due to the discharge delay, at the time that the discharge is actually generated between the Y and A electrodes, the voltage between the Y and A electrode, Vfay, is greater than the discharge firing voltage Vfay. Accordingly, a strong discharge rather than a weak discharge may be generated between the A and Y electrodes due to the high voltage caused by the discharge delay. Another strong discharge may be generated between the X and Y electrodes by the strong discharge between the A and Y electrodes. Therefore, more positive wall charges may be generated in the cells than charges that would be formed during a normal rising period, and a greater number of priming particles may be generated. Accordingly, a strong discharge may be generated during the falling period by the wall charges and the priming particles, and the wall charges between the X and Y electrodes, as shown in FIG. 5, may not be properly eliminated. In this case, a high voltage may remain between the X and Y electrodes in the cell when the reset period ends. This high wall voltage may generate a misfiring between the X and Y electrodes during the sustain period even though the cell has not experienced the address discharge. An exemplary embodiment for preventing this misfiring discharge will be described in more detail with reference to FIG. 6.

Figure 6:
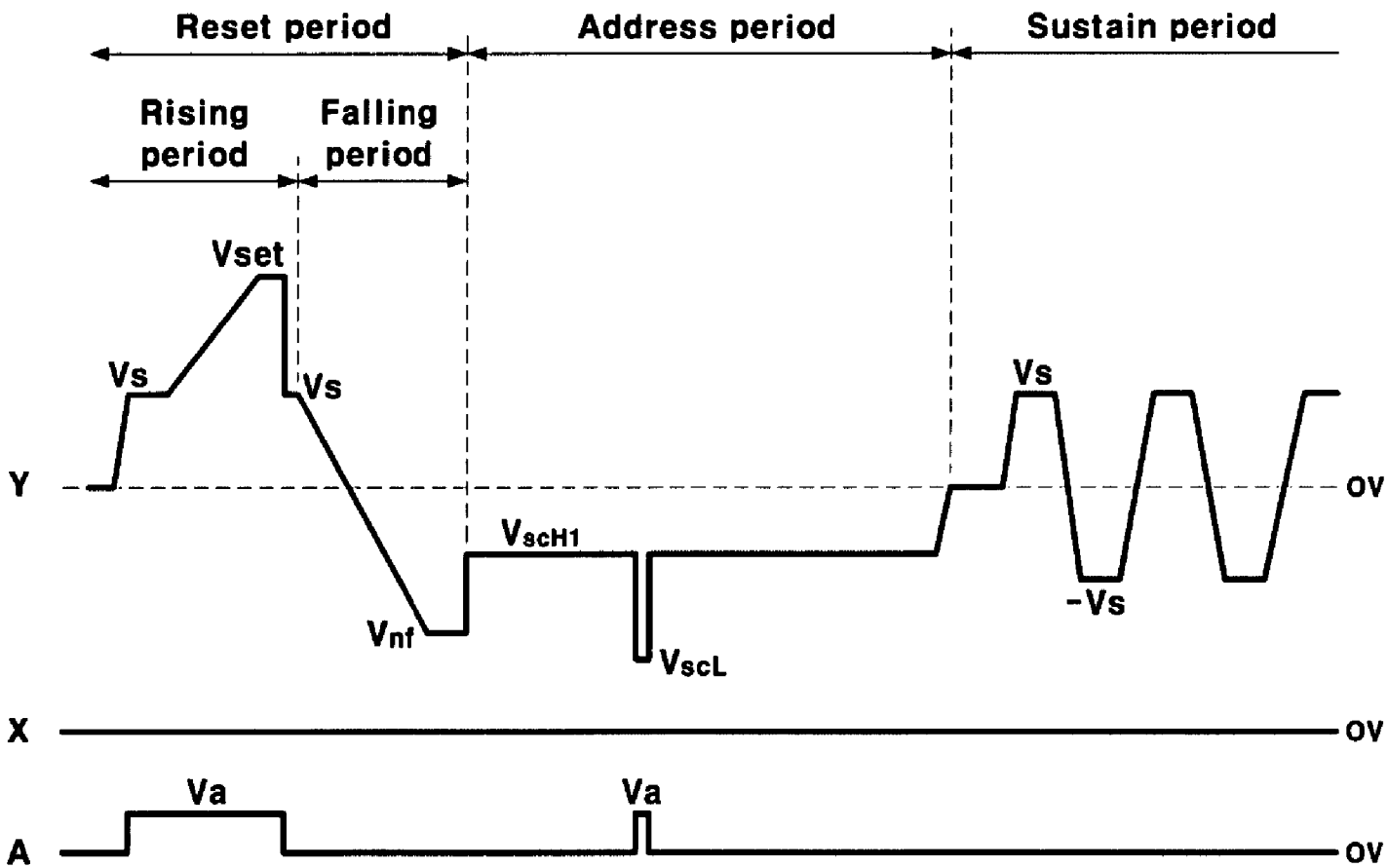
FIGS. 6, 7, 8 and 9 show driving waveform diagrams of a plasma display panel according to second, third fourth and fifth exemplary embodiments of the present invention.

FIG. 6 is a driving waveform diagram of a plasma display panel according to a second exemplary embodiment of the present invention. While the driving waveform applied to the Y electrode according to the second exemplary embodiment of the present invention is similar to the first exemplary embodiment, the A electrode in the second exemplary embodiment is biased at a constant voltage in the rising period of the reset period.

In the second embodiment, during the rising period of the reset period, the voltage of the Y electrode is gradually increased from the voltage Vs to the voltage Vset while the A electrode is biased at the constant voltage Va which is higher than the reference voltage 0V. Accordingly, it is not necessary to use an additional power source to apply the bias voltage to the A electrode if the constant voltage Va is used as the bias voltage of the A electrode. When the voltage of the Y electrode is increased while the A electrode is biased at the voltage Va, the voltage between the A and Y electrodes is less than the voltage between these two electrodes in the first exemplary embodiment. Therefore, the voltage between the X and Y electrodes exceeds the discharge firing voltage. As a result, a weak discharge is generated between the X and Y electrodes thereby forming priming particles, and the voltage between the A and Y electrodes exceeds a discharge firing voltage. The discharge delay is reduced between the A and Y electrodes by the priming particles. Accordingly, a weak discharge instead of a strong discharge is generated between the A and Y electrodes, and the wall charges are properly formed. Therefore, misfiring may also be prevented in the falling period of the reset period because a strong discharge was not generated.

While the A electrode is biased at the constant voltage Va during the rising period in the second embodiment shown in FIG. 6, the A electrode may be biased at the constant voltage Va only in an early stage of the rising period. As described above, a strong discharge during the rising period may be prevented by preventing the voltage between the A and Y electrodes from exceeding the discharge firing voltage prior to the time that the voltage between the X and Y electrodes exceeds the discharge firing voltage. Therefore, the A electrode may be biased at the constant voltage Va only at the early stage of the rising period. After the weak discharge is generated between the A and Y electrodes, the voltage of the A electrode may be set back to the reference voltage 0V. The voltage of the A electrode may be gradually increased. When the voltages of the Y and A electrodes are increased together, a weak discharge is generated between the X and Y electrodes because the voltage between the A and Y electrodes is further reduced to less than this same voltage when the A electrode is biased at the reference voltage 0V.

The voltage of the A electrode may be increased during the entire duration of the rising period or during only a portion of this period.

Also, instead of increasing the voltage of the A electrode, the A electrode may be floated. When the voltage of Y electrode is increased and the A electrode is floated, the voltage of the A electrode increases according to an increase in the voltage of the Y electrode because of a capacitance formed between the A and Y electrodes, thereby achieving the waveform shown in FIG. 6. The voltage of the A electrode may be floated during the entire duration of the rising period or during only a portion of this period.

The address discharge is determined by the density of the priming particles and the wall voltage generated in the discharge space. In particular, the final voltage Vnf of the reset period becomes very low in the first and second embodiments of the present invention because the reset operation is made while the reference voltage 0V is applied to the X electrode. As a result, a lot of wall charges between the A and Y electrodes are erased at the end of the reset period, and accordingly, generation of a discharge between the A and Y electrodes are highly influenced by the amount of priming particles. However, the priming particles are eliminated as time passes. In the driving waveforms according to the first and second exemplary embodiments, the scan pulse of the voltage VscL is sequentially applied to the Y electrode of the first row to the Y electrode of the last row during the address period, and thus the address discharge may not be generated in a Y electrode applied with the scan pulse at a late stage because the discharge delay time is extended due to elimination of the priming particles and the wall charges. Therefore, in a third exemplary embodiment of the present invention, a plurality of Y electrodes sequentially applied with the scan pulse are divided into a plurality of groups according to an application of the scan pulse, and a voltage of a lower scan pulse is applied to the Y electrodes included in the group receiving the scan pulse temporally later. For example, the plurality of Y electrodes may be divided into a first group including odd-numbered Y electrodes and a second group including even-numbered Y electrodes. In this case, after a scan pulse of a first voltage is applied to the Y electrodes included in the first group, a scan pulse of a second voltage lower than the first voltage is applied to the Y electrodes included in the second group.

Figure 7:
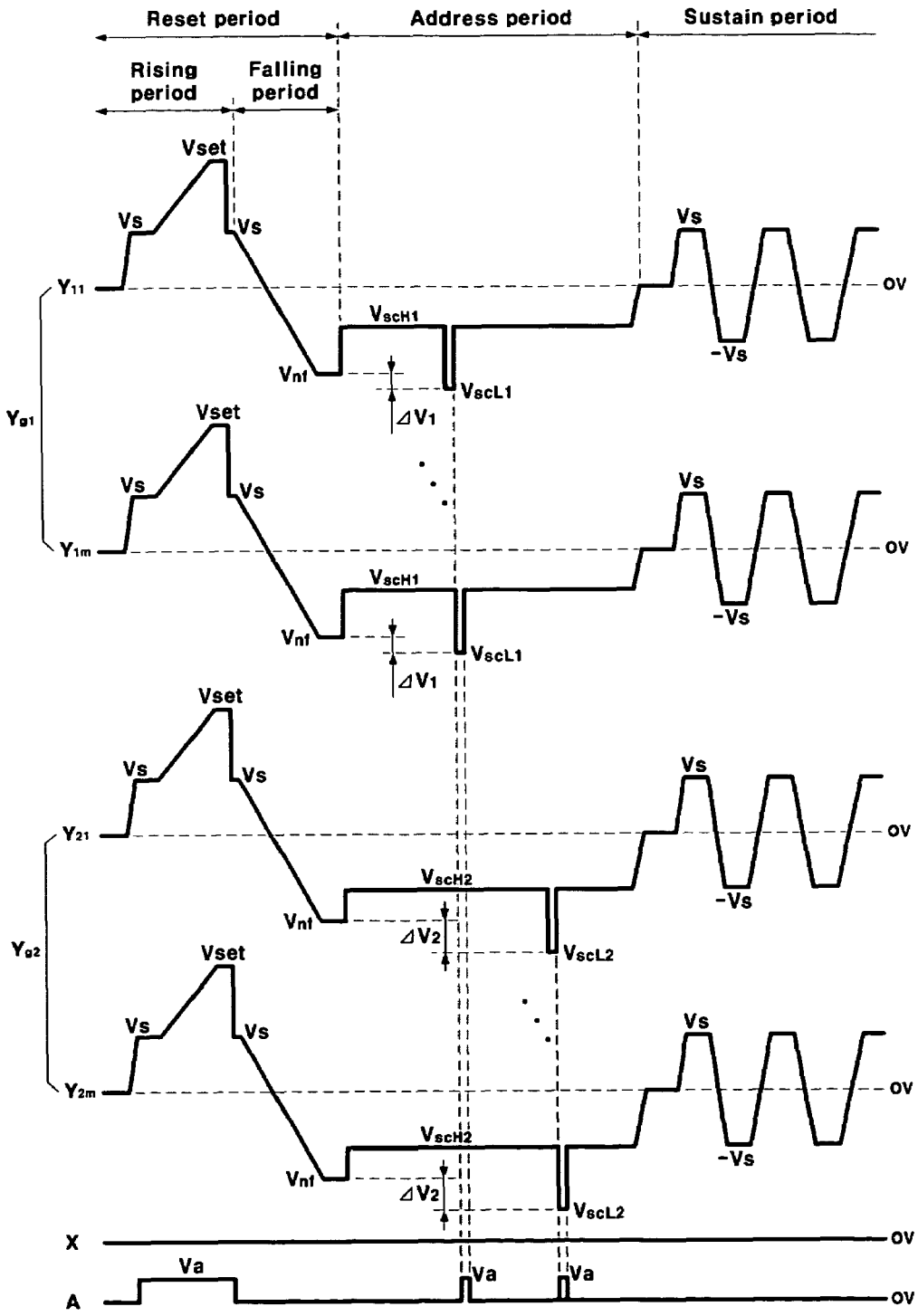

In addition, the plurality of Y electrodes may be divided into a first group including Y electrodes formed upper in the plasma display panel and a second group including Y electrode formed lower in the plasma display panel. Again, in this case, after a scan pulse of a first voltage is applied to the Y electrodes included in the first group, a scan pulse of a second voltage lower than the first voltage is applied to the Y electrodes included in the second group. In such a manner, stable address discharge may be enabled in cells formed on the Y electrode receiving the scan pulse temporally later. FIG. 7 shows such an exemplary embodiment of the present invention.

FIG. 7 is a driving waveform diagram of a plasma display panel according to a third exemplary embodiment of the present invention. In FIG. 7, the plurality of Y electrodes are divided into two groups Yg1 and Yg2 respectively including Y electrodes located upper in the plasma display panel 10 and Y electrodes located lower in the plasma display panel 10. FIG. 7 illustrates that each group includes m number of Y electrodes. That is, the number m equals n/2.

As shown in FIG. 7, during the address period, Y electrodes of turn-on cells are sequentially applied with a scan pulse of a voltage VscL1 while the Y electrodes in the first group Yg1 maintain a voltage VscH1. Subsequently, Y electrodes in turn-on cells are applied with a scan pulse of a voltage VscL2 while the Y electrodes in the second group Yg2 maintain a voltage VscH2. In this instance, the voltage VscH1 is higher than the voltage VscH2, and the voltage VscL1 is higher than the voltage VscL2. In other words, a difference AV2 between the final voltage Vnf in the falling period and the voltage VscL2 in the second group Vg2 is set to be greater than a difference AV1 between the final voltage Vnf in the falling period and the voltage VscL1 in the first group. Then the discharge delay time in the second group becomes reduced and accordingly the address discharge is stably generated in discharge cells including the Y electrodes applied with the voltage VscL2. When the reference voltage 0V is applied to the X electrode during the falling period of the reset period, the final voltage Vnf applied to the Y electrode is a voltage set close to the discharge firing voltage Vfay between the Y and A electrodes and the discharge firing voltage Vfay between the Y and A electrodes is lower than the discharge firing voltage between Y and X electrodes, and accordingly, a relatively large amount of discharge is generated between the Y and A electrodes. As a result of the generation of the large amount of discharge, a large quantity of priming particles are generated between the Y and A electrodes and accordingly the discharge may be stably generated even though the Y electrodes of the first group Yg1 is applied with the voltage VscL1 which is higher than the voltage VscL2.

Similar to the driving waveforms of the first, second and third exemplary embodiments, reset periods of a plurality of subfield are formed as a main reset period having a rising period and a falling period, but reset periods of some of the subfields may be formed as an auxiliary reset period having the falling period only. In other words, every cell is initialized in the main reset period, and cells that have undergone a sustain discharge in a previous subfield are initialized during the auxiliary reset period. Such an exemplary embodiment will now be described in more detail with reference to FIG. 8.

Figure 8:
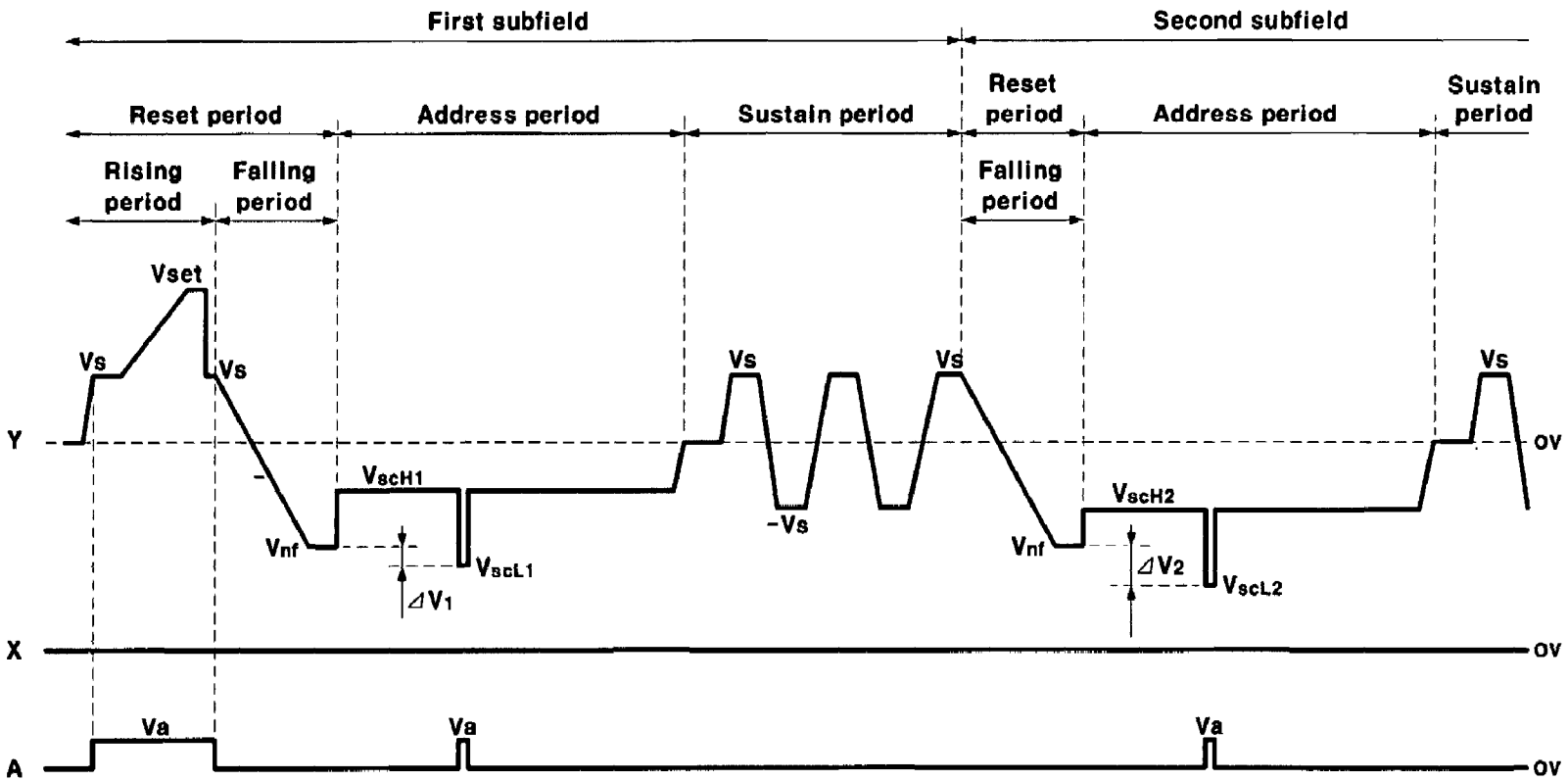

FIG. 8 shows a driving waveform diagram of a plasma display panel of a fourth exemplary embodiment of the present invention. In FIG. 8, two subfields of a plurality of subfields are represented, and for convenience of description the two subfields are respectively illustrated as a first subfield and a second subfield. The first subfield includes a main reset period, and the second subfield includes an auxiliary reset period.

The driving waveform of the first subfield in FIG. 8 is similar to the driving waveform of FIG. 6. However, the reset period of the second subfield includes only a falling period. The voltage of the Y electrode is gradually reduced to the voltage Vnf in the reset period of the second subfield while the sustain discharge pulse of the voltage Vs is applied to the Y electrode in the sustain period of the first subfield.

During the sustain period of the first subfield, a sustain discharge is generated, and negative (−) wall charges are formed on the Y electrode and positive (+) wall charges are formed on the X and A electrodes. As a result, a weak discharge is generated during the falling period of the reset period of the second subfield. This discharge is similar to the discharge generated during the falling period of the reset period of the first subfield when the voltage of the Y electrode is gradually reduced and exceeds the discharge firing voltage. The wall charge condition in the cell after the falling period of the second subfield is equivalent to the wall charge condition after the falling period of the first subfield, because the final voltage Vnf of the Y electrode in the falling period of the second subfield is equal to the final voltage Vnf of the Y electrode in the falling period of the first subfield.

The wall charge condition in the cell and the density of the discharge priming particles are maintained at a condition of the end of the falling period of the first subfield because the address discharge is not generated if the sustain discharge has not been generated during the sustain period of the first subfield. No discharge is generated when the voltage of the Y electrode is reduced to the voltage Vnf. As a result of the applied voltage, after the falling period of the first subfield is finished, the wall voltage formed on the cell reaches near the discharge firing voltage. Accordingly, the wall charge condition and the density of the discharge priming particles established in the reset period of the first subfield are maintained because no discharge is generated in the reset period of the second subfield. During the address period of the second subfield, when the voltage VscL1 is applied to the Y electrode to trigger the address discharge in the cell that did not experience an address discharge in the first subfield, the discharge delay time is extended and the address discharge may not be generated since the discharge priming particle and the wall charge are eliminated as time passes, as described above. Accordingly, a scan pulse of the voltage VscL2 and an address pulse of the voltage Va are respectively applied to the Y and A electrodes to select turn-on cells during the address period of the second subfield according to the fourth embodiment of the present invention. Y and A electrodes in cells that are not selected during the address period of the second subfield are respectively biased at a voltage VscH2 and the reference voltage 0V. The voltage VscH2 is lower than a voltage VscH1 Accordingly, the discharge delay time is reduced and the address discharge is stably generated in the discharge cells of the second subfield.

In FIG. 8, a non-scan voltage and a scan voltage applied to a plurality of Y electrodes are set to be equivalent during an address period of each subfield similar to the driving waveform of FIG. 4, but different non-scan and scan voltages may be applied to a plurality of Y electrodes, respectively, similar to the driving waveform of FIG. 7.

As described, the discharge between the A and Y electrodes is greatly influenced by the priming particles during the address period in the waveforms of the first and second embodiments of the present invention, and a stable address discharge may be generated by the waveforms of the first and second embodiments according to the third and fourth embodiments of the present invention.

As a voltage slope of an electrode becomes gentler, the discharge is generated more weakly. However, during the falling period of the second subfield, a final voltage applied to the Y electrode is set to be the voltage Vnf which is a voltage close to the discharge firing voltage between the Y and X electrodes, and accordingly, a falling slope becomes very steep. When the falling slope becomes very steep, a strong discharge may be generated during the falling period. A method for generating a weak discharge by controlling a falling slope of a voltage of the Y electrode in the reset period of the second subfield will now be described in more detail with reference to FIG. 9.

Figure 9:
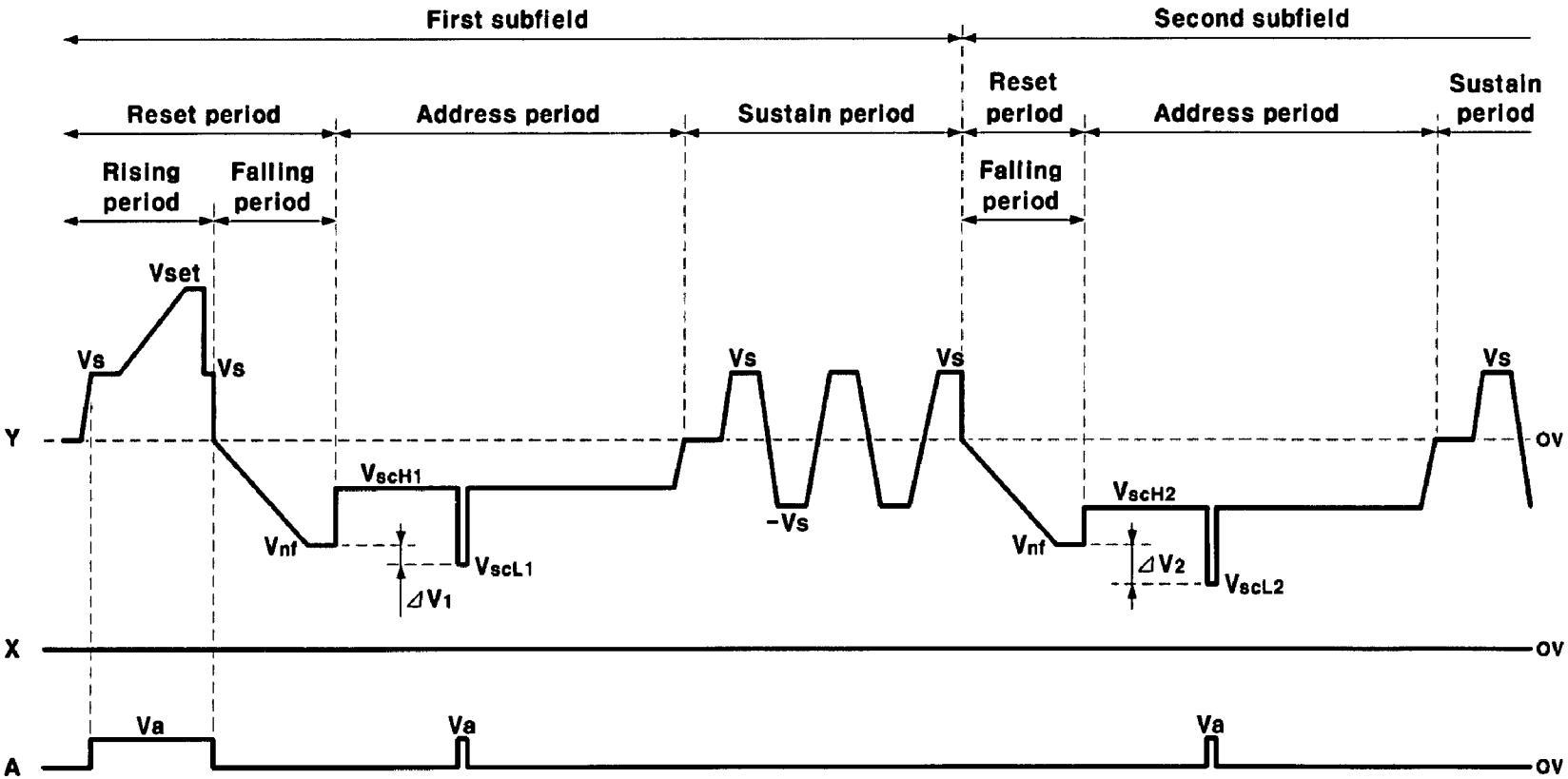

FIG. 9 is a driving waveform diagram of a plasma display panel according to a fifth exemplary embodiment of the present invention. While the driving waveform of FIG. 9 is similar to the driving waveform in FIG. 8, a start point in the falling period of the reset period in the second subfield is set to be a voltage lower than the voltage Vs in FIG. 9.

As described above, when the voltage slope is changed more gently as time passes, the discharge generated in the cell becomes weaker. When a falling start voltage of the Y electrode is set to be a lower voltage, the falling slope of the Y electrode may be set to be gentler in the predetermined falling period according to the fifth exemplary embodiment of the present invention. Then the voltage of the Y electrode is changed slower compared to the fourth embodiment of the present invention, and accordingly, generation of the strong discharge may be prevented even though the strong discharge is generated in the rising period. In this instance, an additional power source may not be necessary when the falling start voltage of the Y electrode is set to be the reference voltage 0V. In addition, a starting point of the falling period of the reset period in the first subfield may also be set to be lower than the voltage Vs.

As described above, the plurality of Y electrodes are applied with different levels of scan voltages to thereby trigger a stable address discharge in the address discharge period.

As described above, according to the exemplary embodiments of the present invention, a board for driving the sustain electrode is not required because the driving waveform is applied to the scan electrode while the sustain electrode is biased at a constant voltage. In other words, a single integrated board is sufficient for driving the electrodes, and the cost is reduced.

When the scan and sustain electrodes have separate driving boards, the impedance formed on the scan driving board is different from the impedance formed on the sustain driving board. This difference occurs because the driving waveforms in the reset period and the address period are supplied mainly from the scan driving board. As a result, the sustain discharge pulse applied to the scan electrode in the sustain period and the sustain discharge pulse applied to the sustain electrode are different. According to the exemplary embodiments of the present invention, however, the impedance on the path for applying the sustain discharge pulse may be controlled to be within a certain level because the pulse for the sustain discharge is supplied from the scan driving board.

In addition, according to the exemplary embodiments of the present invention, the scan electrodes are grouped into a plurality of groups when the scan voltage is sequentially applied to the scan electrodes and a scan voltage applied to the scan electrodes is set to be different with each other for each group such that the address discharge is stably generated during the address period.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A method for driving a plasma display panel having a plurality of first electrodes, a plurality of second electrodes, and a plurality of third electrodes extending in a direction crossing the first and second electrodes while one frame is divided into a plurality of subfields, the method comprising:

dividing the plurality of first electrodes into a plurality of groups comprising a first group and a second group, the plurality of second electrodes being biased at a first voltage during a reset period, an address period, and a sustain period; and during the address period:

selectively applying a second voltage to the first group of the plurality of first electrodes, the second voltage for selecting discharge cells among a plurality of discharge cells coupled to the first group; and selectively applying a third voltage lower than the second voltage to the second group of the plurality of first electrodes, the third voltage for selecting discharge cells among a plurality of discharge cells coupled to the second group.

2. The method of claim 1, further comprising:

during the reset period:

gradually increasing a voltage of a first electrode of the plurality of first electrodes from a fourth voltage to a fifth voltage; and gradually decreasing a voltage of the first electrode from a sixth voltage to a seventh voltage, wherein a voltage of a third electrode of the plurality of third electrodes is set to be a positive voltage during at least a portion of a period in which a level of the voltage of the first electrode increases to a level of the fifth voltage.

3. The method of claim 2, wherein the second voltage and the third voltage are lower than the seventh voltage.

4. The method of claim 1, wherein the first voltage is set to be a ground voltage.

5. The method of claim 1, further comprising, during the sustain period, alternately applying a fourth voltage and a fifth voltage to the plurality of first electrodes, the fourth voltage being higher than the first voltage and the fifth voltage being lower than the first voltage.

6. The method of claim 1, wherein the first group of the plurality of first electrodes comprises odd-numbered electrodes, and the second group of the plurality of first electrodes comprises even-numbered electrodes.

7. The method of claim 1, wherein the first group of the plurality of first electrodes is formed in an upper portion of the plasma display panel, and the second group of the plurality of the first electrodes is formed in a lower portion of the plasma display panel.

8. The method of claim 1, wherein a fourth voltage is applied to a third electrode of the plurality of third electrodes of a turn-on discharge cell in a plurality of discharge cells coupled to a first electrode of the plurality of first electrodes applied with the second voltage or the third voltage.

9. The method of claim 1, wherein a voltage applied to a first electrode included in the first group of the plurality of first electrodes but not applied with the second voltage is higher than a voltage applied to the first electrode included in the first group of the plurality of first electrodes but not applied with the third voltage.

10. A method for driving a plasma display panel having a plurality of first electrodes, a plurality of second electrodes, and a plurality of third electrodes extended in a direction crossing the first and second electrodes while one frame is divided into a plurality of subfields, at least one subfield among the plurality of subfields comprising a main reset period for initializing all discharge cells, and at least one subfield of the plurality of subfields comprising an auxiliary reset period for initializing discharge cells that have experienced a sustain discharge in a previous subfield, the plurality of second electrodes being biased at a first voltage during a reset period, an address period, and a sustain period, the method comprising:

during the address period, selectively applying a second voltage to the plurality of first electrodes, the second voltage for selecting discharge cells among a plurality of discharge cells coupled to the first electrodes, wherein the second voltage in the at least one subfield comprising the main reset period is higher than the second voltage in the at least one subfield comprising the auxiliary reset period.

11. The method of claim 10, further comprising, during the reset period, gradually decreasing a voltage of a first electrode of the plurality of first electrodes from a third voltage to a fourth voltage, wherein a difference between the second voltage and the fourth voltage in the at least one subfield comprising the main reset period is less than a difference between the second voltage and the fourth voltage in the at least one subfield comprising the auxiliary reset period.

12. The method of claim 11, further comprising, during the main reset period, gradually increasing a voltage of the first electrode from a fifth voltage to a sixth voltage, wherein a voltage of a third electrode of the third electrodes is set to be a positive voltage during at least a portion of a period in which a level of the voltage of the first electrode increases to a level of the sixth voltage.

13. The method of claim 10, wherein the first voltage is set to be a ground voltage.

14. The method of claim 10, wherein:

a third voltage is applied to a first electrode of the plurality of first electrodes that is not applied with the second voltage; and the third voltage is higher during a subfield comprising the main reset period than during a subfield comprising the auxiliary reset period.

15. The method of claim 10, wherein a third voltage is applied to a third electrode of the plurality of third electrodes of a turn-on discharge cell in a plurality of discharge cells formed on a first electrode of the plurality of first electrodes applied with the second voltage.

16. The method of claim 10, further comprising, during the sustain period, alternately applying a third voltage and a fourth voltage to the plurality of first electrodes, the third voltage being higher than the first voltage and the fourth voltage being lower than the first voltage.

* * * * *